US005598170A

United States Patent [19]

Nakase

[11] Patent Number: 5,598,170

[45] **Date of Patent: *Jan. 28, 1997**

[54] GLASS ANTENNA FOR AUTOMOBILES

[75] Inventor: Kazuhiko Nakase, Tokyo, Japan

[73] Assignee: Harada Kogyo Kabushiki Kaisha, Tokyo, Japan

[ * ] Notice: The term of this patent shall not extend beyond the expiration date of Pat. No. 5,285,048.

[21] Appl. No.: 831,482

[22] Filed: Feb. 5, 1992

[51] Int. Cl.[6] ..... H01Q 1/02; H01Q 1/32

[52] U.S. Cl. ..... 343/704; 343/713

[58] Field of Search ..... 343/704, 713; H01Q 1/02, 1/32

[56] References Cited

U.S. PATENT DOCUMENTS 5,083,134 1/1992 Saitou et al. ..... 343/704

5,285,048 2/1994 Nakase ..... 343/713

*Primary Examiner*—Michael C. Wimer

*Attorney, Agent, or Firm*— Koda and Androlia

[57] ABSTRACT

An automobile antenna including a defogging heater wire and a conductor combined into a simple structure for a good FM reception. FM choke coils, which prevents high-frequency signals from being transmitted from power supply circuit to the heater wire, is installed between the heater wire terminal and the power supply circuit for the heater wire, and the heater wire which resonates in the FM frequency band but not in the AM frequency band is inductively coupled to the conductor which is installed on the surface of the window glass and can resonate in the FM frequency band but not in the AM frequency band. The heater wire and conductor are installed in such a positional relationship as to create a double resonance.

6 Claims, 5 Drawing Sheets

GLASS ANTENNA FOR AUTOMOBILES

DETAILED DESCRIPTION OF THE INVENTION

1. Field of Industrial Utilization

The present invention relates to a glass antenna for automobiles which uses, as a part of the antenna, a defogging heater wire installed in the rear windshield and more particularly to an antenna which is a combination of the heater wire and a separately mounted antenna to receive FM and AM broadcasts, etc.

2. Prior Art

The antennas shown in FIGS. 6 and 7 are known as examples of conventional automobile glass antennas.

In the antenna shown in FIG. 6, a main antenna A which has an antenna output terminal is formed on the surface of window glass 10 as a separate element from a defogging heater wire H. Generally, main antennas are formed in an asymmetrical shape so that they are resonant in the FM frequency band at the most optimized reception and maintain the improved FM directionality. However, even if such a structure is taken, matching cannot be accomplished for the entire FM reception frequency band because the area which can be used as an antenna is small. As a result, the FM reception sensitivity is low, and the FM directionality cannot be improved sufficiently. In addition, AM reception sensitivity is also low. As a result, in order to improve the FM and AM reception sensitivities, an FM compensating amplifier 31 and an AM compensating amplifier 32 are used between the antenna output terminal and a feeder cable F.

In the conventional antenna illustrated in Figure 7, an AM choke coil CHa and an FM choke coil CHfO are utilized. These coils are for blocking high-frequency signals at both terminals of the defogging heater wire H so that the heater wire H thus "insulated in terms of high-frequency" from power supply circuit B by the choke coils can be used as an antenna. As seen from the above, since the heater wire H is used as an antenna though it is originally not designed to be an antenna, matching cannot be obtained in the FM frequency band, and the FM reception sensitivity is low. On the other hand, since there is a large amount of stray capacitance for the AM frequency band, the capacitance splitting loss increases, which brings an AM reception sensitivity drop. As a result, in order to compensate for the poor FM and AM reception sensitivities, an FM compensating amplifier 31 and an AM compensating amplifier 32 are installed between the antenna output terminals and the feeder F.

In the above-described conventional antennas, a matching for the entire FM reception frequency band cannot be obtained if only the main antenna A or heater wire H is used, which results in FM reception sensitivity drop. This is the reason for using the FM compensating amplifier 31. When the FM compensating amplifier 31 is used, it is necessary that such an amplifier 31 is a broad-band amplifier which can cover the entire FM reception frequency band. This, however, brings about noise and cross-modulation or intermodulation in intense electric fields.

SUMMARY OF THE INVENTION

The object of the present invention is to provide a glass antenna for automobiles which has a good FM reception with a simple structure of a combination of a heater wire and a conductor.

In the present invention, an FM choke coil, which insulates in terms of high-frequency the defogging heater wire from a power supply circuit, is utilized. The defogging heater wire which resonates in the FM frequency band but not in the AM frequency band is inductively coupled with a conductor (a wire) which is installed on the surface of window glass and resonates in the FM frequency band but not in the AM frequency band. The defogging heater wire and the conductor are installed in such a positional relationship that they create a state of double resonance.

DETAILED DESCRIPTION OF THE INVENTION

Figure 1:
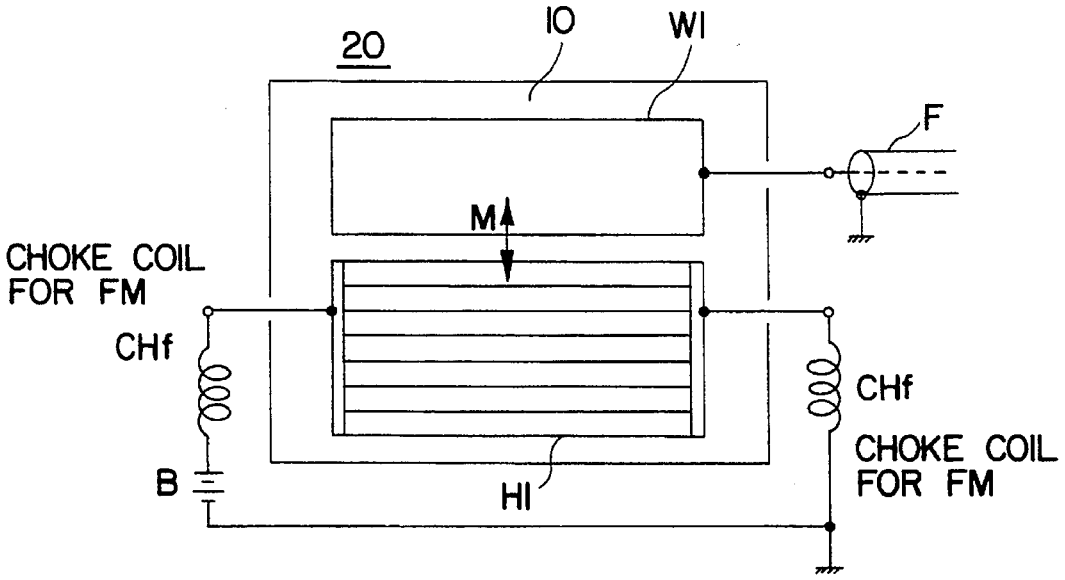
FIG. 1 illustrates one embodiment of the present invention.

FIG. 1 is a block diagram representing one embodiment of the present invention.

This embodiment is for an automobile glass antenna which receives FM and AM reception frequency bands and is composed of a heater wire H1, a wire (conductor) W1 and an FM choke coil CHf.

The heater wire H1 is one used to remove window glass fog (called "defogging heater wire"). This defogging heater wire H1 can resonate in the FM reception frequency band but not in the AM frequency band. The wire W1 can resonate in the FM reception frequency band but not in the AM reception frequency band and is installed in a window glass 10. The wire W1 has an output terminal, and a feeder F is connected to the output terminal of this wire W1.

The FM choke coil CHf is provided between the terminal of the heater wire H1 and a power source circuit B so that the choke coil CHf insulates (within the FM reception frequency band), in terms of high-frequency, the heater wire H1 from the power source circuit B. In other words, the choke coils prevents high-frequency signals from being transmitted from the power source circuit B to the heater wire H1.

For the FM reception frequency, the heater wire H1 and wire W1 are inductively coupled, and the heater wire H1 and wire W1 are installed in such a positional relationship that the coupling strength is more or less a critical coupling value, thus forming a state of double resonance. The coupling strength between the heater wire H1 and the wire W1 can vary depending upon the distance and the positional relationship between the two. When the coupling strength becomes greater than the critical coupling value, the frequency band characteristics (reflection loss characteristics)

can change from single-peak characteristics to double-peak characteristics. The optimal coupling between the two is obtained by changing, with a use of a network analyzer, the positional relationship of the heater wire H1 and wire W1 until a desired frequency band range is obtained and until a dimensional and positional relationship which produce the minimum reflection loss are obtained.

For the AM reception frequency band, only the wire W1 acts as an antenna. Accordingly, the shape and position of the wire W1 are determined so that a stray capacitance of the wire W1 is minimal. More specifically, an antenna with a small stray capacitance can be obtained if the wire W1 is provided approximately 3 cm or higher above the automobile body 20 and the heater wire H1.

Next, the operation of the above-described embodiment will be described.

An FM reception will be described first.

Figure 2A:
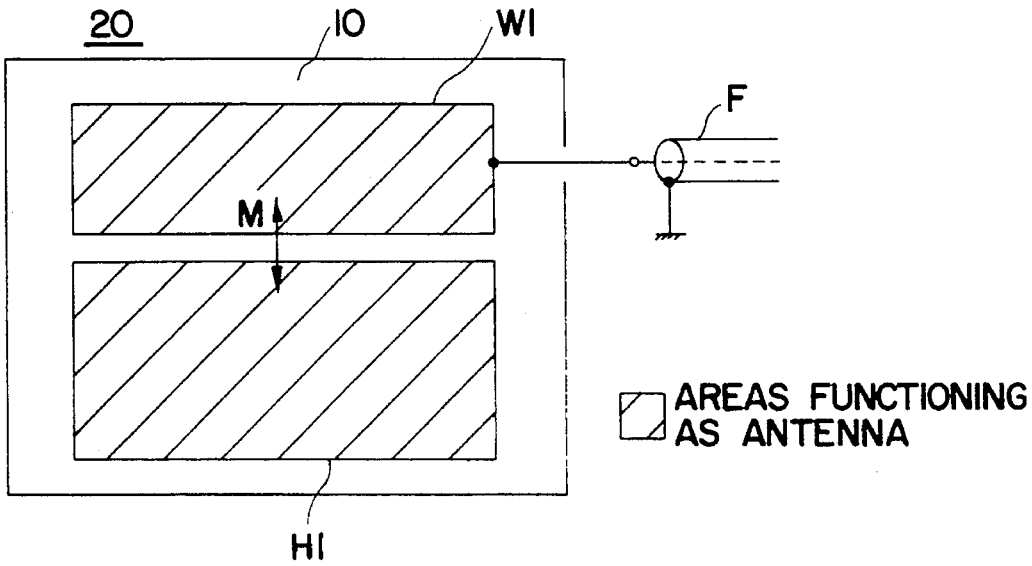
FIGS. 2*a* and 2*b* show the principle of operation for an FM reception frequency band and an equivalent circuit thereof in the embodiment above.
Figure 2B:
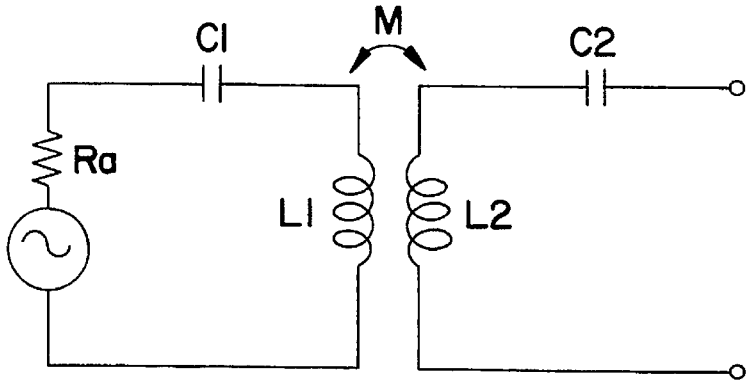

FIGS. 2*a* and 2*b* a principle of operation and an equivalent circuit for the FM reception frequency band in the above embodiment. For the FM reception frequency band, as shown in FIG. 2(*a*), both the wire W1 and heater wire H1 act as an antenna. The wire W1 and heater wire H1 are both resonant in the FM reception frequency band and are inductively coupled together so that a state of double resonance is created. The coupling strength of the two is more or less in a critical coupling; accordingly, the frequency band characteristics (reflection loss characteristics), when seen from the antenna output terminal (i. e., the terminal of the wire W1), show double-peak characteristics, thus broad-band characteristics are obtained. As a result, matching of the antenna and feeder F can be obtained for the entire FM reception frequency band, and thus a good FM reception is obtained without using an FM compensating amplifier which is necessary in the conventional antennas.

In the equivalent circuit shown in FIG. 2(*b*), the equivalent capacitance C1 and equivalent inductance L1 of the heater wire H1 and the radiation resistance Ra of the antenna exist as conceptional entities. The equivalent capacitance C2 and equivalent inductance L2 of the wire W1 also exist as conceptional entities.

Next, an AM reception in the above-described embodiment will be described.

Figure 3A:
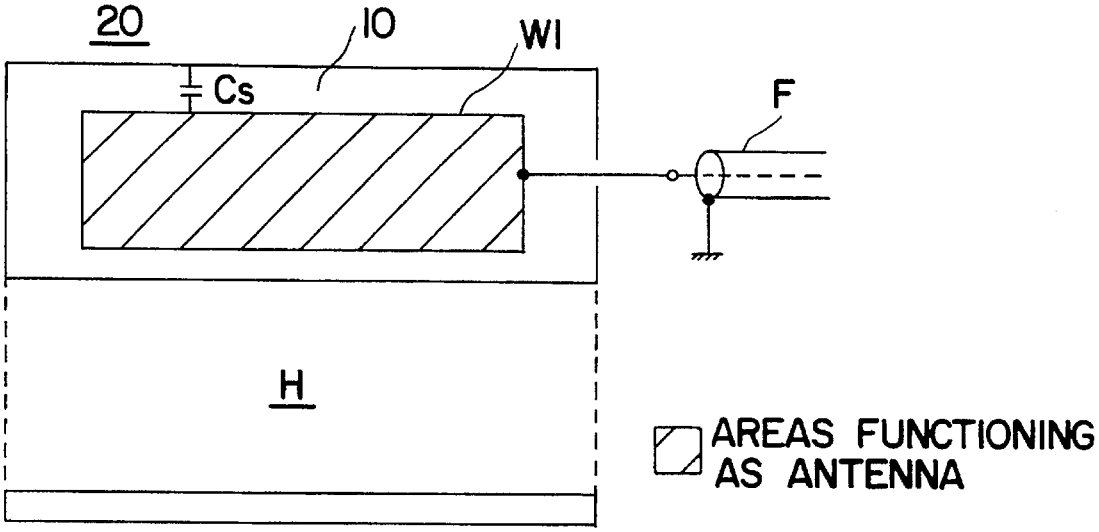
FIGS. 3*a* and 3*b* show the principle of operation for an AM reception frequency band and an equivalent circuit thereof in the embodiment above.
Figure 3B:
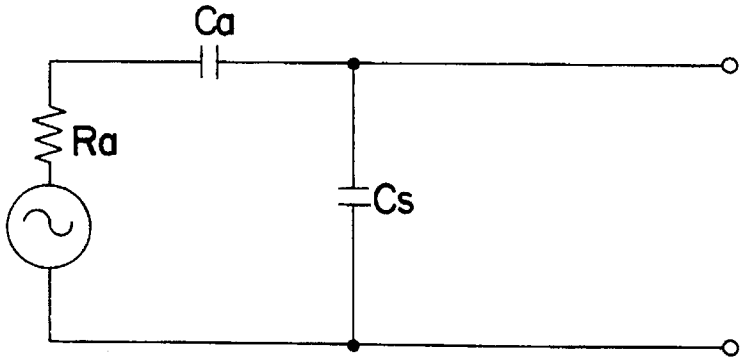

FIGS. 3*a* and 3*b* show a principle of operation and an equivalent circuit for the AM reception frequency band in the above embodiment. For the AM reception frequency band, only the wire W1 acts as an antenna. The reason why only the wire W1 can act as an antenna is that the wire W1 and the heater wire H1 are both extremely short in length compared to the AM reception wavelength, and since the both ends of the heater wire H1 are insulated via the FM choke coil CHf, the heater wire H1 is more or less equivalent to a grounding conductor; and as a result, there is absolutely no electrical coupling between the wire W1 and the heater wire H1. Because of this fact, there is no inflow of noise from the power supply B into the wire W1 during the AM reception.

In the above embodiment, since the wire W1 and the automobile body 20 (i.e., the vehicle body as a grounding plate) are sufficiently spaced, the antenna has only a small stray capacitance. Accordingly, the capacitance splitting loss, which is caused by antenna capacitance Ca (which acts effectively as an antenna) and stray capacitance Cs (which acts ineffectively), can be minimal, and therefore, an effective AM reception is obtainable.

Figure 4:
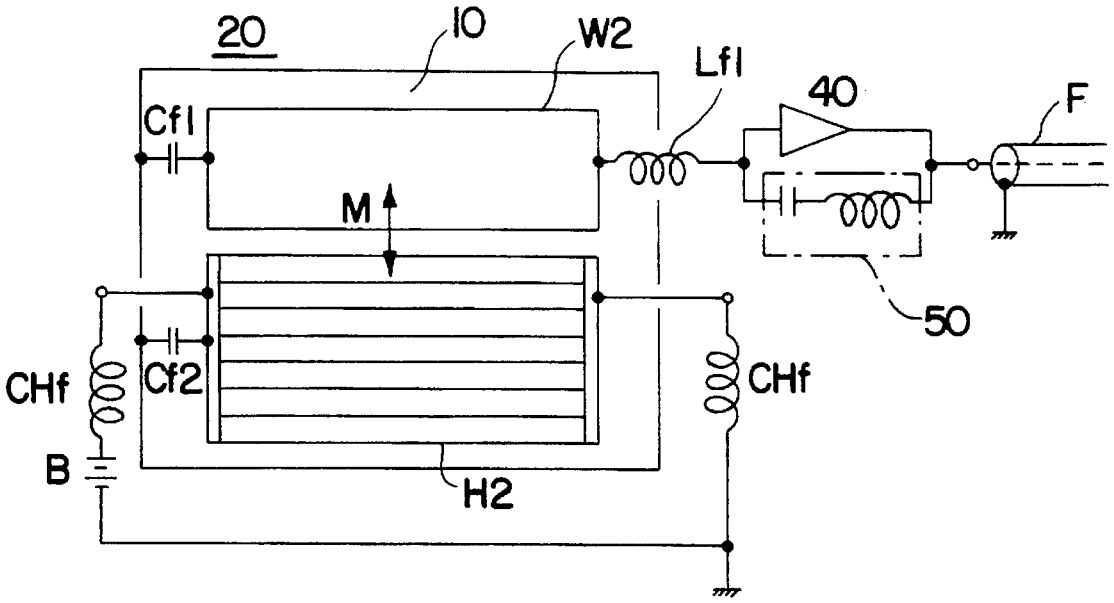
FIG. 4 illustrates another embodiment of the present invention.

FIG. 4 is a circuit diagram of another embodiment of the present invention.

Figure 5:
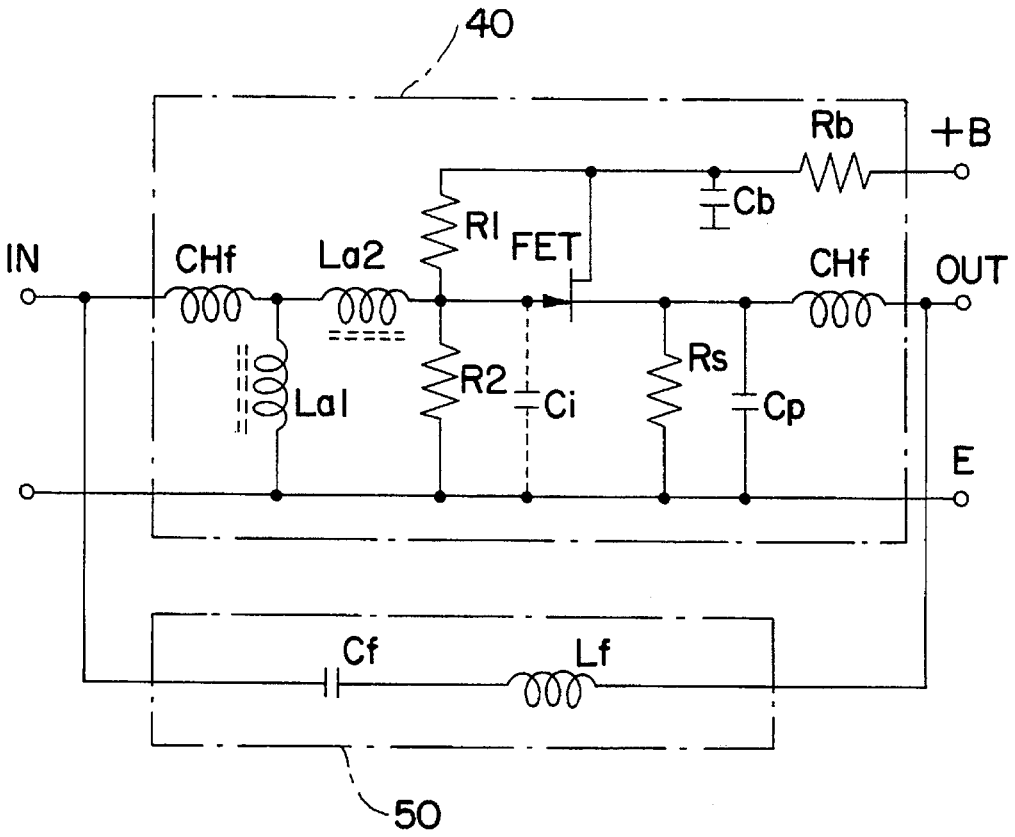
FIG. 5 is a circuit diagram of one example of the AM impedance conversion circuit used in the embodiment illustrated in FIG. 4.
Figure 6:
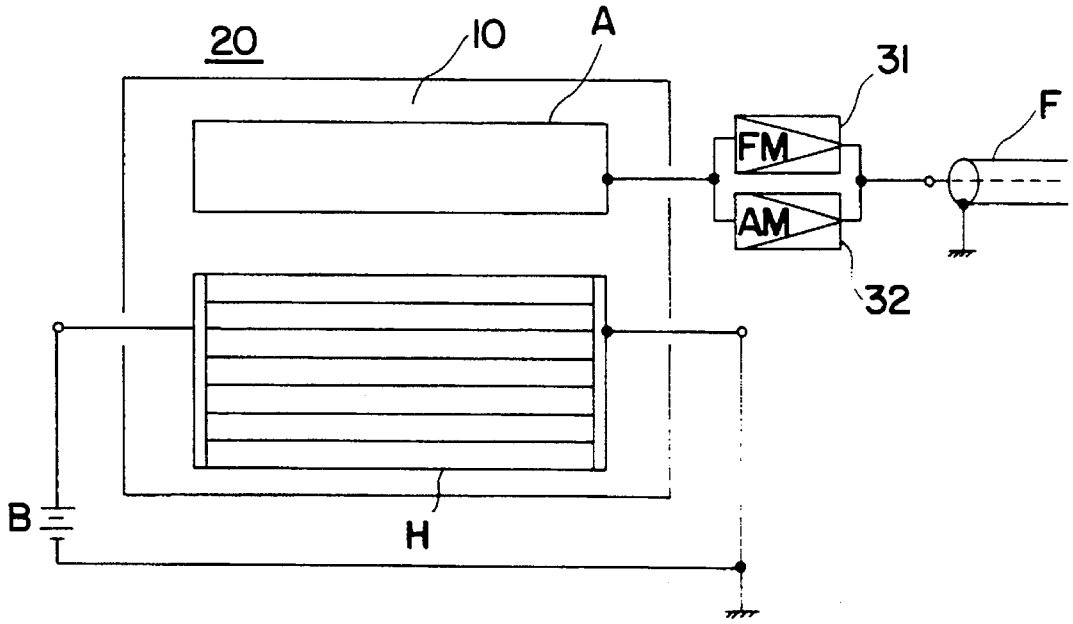
FIG. 6 PRIOR ART
FIG. 6 is an explanatory diagram of a conventional example.
Figure 7:
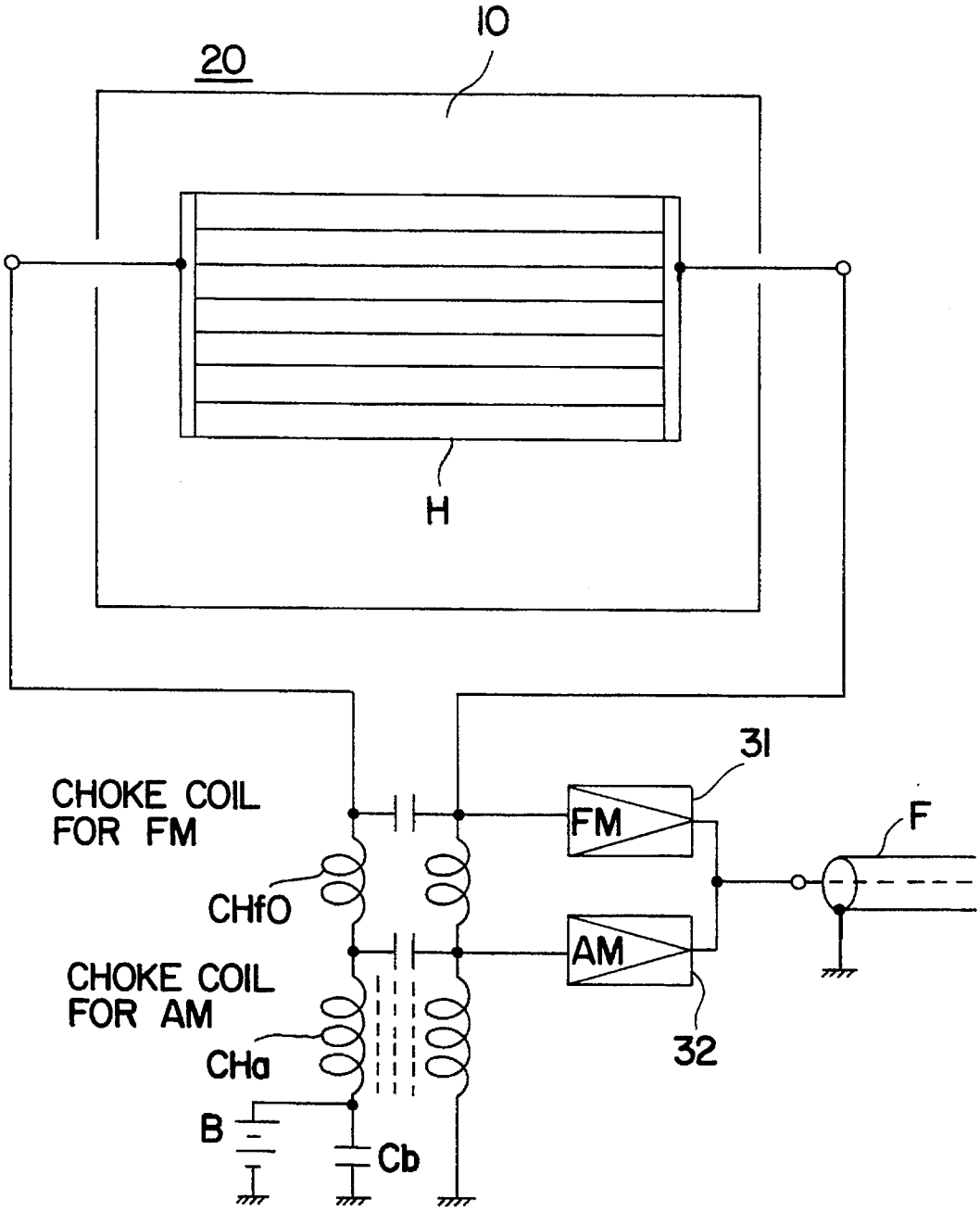
FIG. 7 PRIOR ART
FIG. 7 is an explanatory diagram of another conventional example.

In this embodiment, a compensating circuit, which consists of an AM impedance conversion circuit 40 and an FM matching-bypass circuit 50, is inserted between the feeder F and the output terminal of the wire W1. The AM impedance conversion circuit 40 converts high impedance which is for AM reception frequency into low impedance. An example of this AM impedance conversion circuit 40 is shown in FIG. 5.

Because of the AM impedance conversion circuit 40 thus installed, it is possible to greatly reduce the capacitance splitting loss in the feeder F compared to the embodiment shown in FIG. 1.

In the embodiment shown in FIG. 4, the wire W2, involving a resonance frequency adjusting capacitor Cf1 and a resonance frequency adjusting inductor Lf1, is resonant in the FM reception frequency band. However, either the resonance frequency adjusting capacitor Cf1 or the resonance frequency adjusting inductor Lf1 can be omitted. It is also possible to shape the wire W2 such that it can solely resonate in the FM reception frequency band. Furthermore, in the embodiment shown in FIG. 4, the heater wire H2, involving the resonance frequency adjusting capacitor Cf2, is resonant in the FM reception frequency band. It is, however, possible to use a resonance frequency adjusting inductor instead of the resonance frequency adjusting capacitor Cf2; and it is also possible to shape the heater wire H2 such that the heater wire H2 can resonate in the FM reception frequency band only. Incidentally, both the resonance frequency adjusting capacitors and resonance frequency adjusting inductors can be utilized in order to achieve a resonance in the FM reception frequency band as in the case of the embodiment illustrated in FIG. 1.

Furthermore, it is also possible to use other type of conductors instead of the wire W1. For example, transparent conductors obtained by forming silver, tin, etc., into a thin film with a thickness of a few microns can be used instead of the wire W1. In addition, though the above description is made about the reception of FM and AM frequency bands, the antenna of the present invention can be used for a first reception frequency which is not the FM reception frequency and for a second reception frequency which is not the AM reception frequency.

According to the present invention, since the matching for the entire FM reception frequency can be accomplished by a simple structure, a good FM reception is obtainable. As a result, the FM compensating amplifiers used in the conventional antennas are unnecessary, and the cost of the antenna can be low. Furthermore, a generation of noise and an occurrence of cross modulation, etc. are prevented.

I claim:

1. A glass antenna for automobiles for receiving the FM broadcast band and the AM broadcast band, said antenna comprising:

a defogging heater wire which resonates in said FM broadcast band but not in said AM broadcast band, a choke coil provided between a terminal end of said heater wire and a power supply circuit for preventing passage of signals in said FM broadcast band, and a conductor which is installed in said window glass and has an output terminal, said conductor being resonant in said FM broadcast band but not in said AM broadcast band, wherein said heater wire and conductor are installed in such a positional relationship that said heater wire and conductor are inductively coupled together in said FM broadcast band, said heater wire and conductor together are respectively capable of reception in said FM broadcast band, and said heater wire and conductor are not inductively coupled in said AM broadcast band so that reception of said AM broadcast band is accomplished only by said conductor.

2. A glass antenna for automobiles according to claim 1 wherein:

said heater wire has a dimension by which said wire resonates independently in said FM broadcast band; and said conductor has a dimension by which said conductor resonates independently in said FM broadcast band.

3. A glass antenna for automobiles according to claim 1, wherein said heater wire and said conductor are substantially critically coupled in said FM broadcast band.

4. A glass antenna for automobiles according to claim 1, wherein said output terminal of said conductor is connected directly to a feeder.

5. A glass antenna for automobiles according to claim 1, wherein:

said heater wire, involving a resonance frequency adjusting inductor or resonance frequency adjusting capacitor, resonates in said FM broadcast band; and said conductor, involving a resonance frequency adjusting inductor or resonance frequency adjusting capacitor, resonates in said FM broadcast band.

6. A glass antenna for automobiles according to claim 1, wherein said output terminal of said conductor is connected to a feeder via a compensating circuit which includes a matching circuit for said FM broadcast band and an active impedance converter which converts high antenna impedance for said AM broadcast band into a low impedance.

* * * * *